US005428437A

United States Patent [19]

Carter et al.

[11] Patent Number: 5,428,437

[45] Date of Patent: Jun. 27, 1995

[54] ROLL MEMBER WEAR INDICATOR

[75] Inventors: Daniel L. Carter, Scottsville; Steven W. Baldwin, Fairport; Richard F. Scarlata, Rochester, all of N.Y.

[73] Assignee: Xerox Corporation, Stamford, Conn.

[21] Appl. No.: 232,966

[22] Filed: Apr. 25, 1994

[51] Int. Cl.[6] ..... G03G 21/00

[52] U.S. Cl. ..... 355/308; 492/9; 271/314

[58] Field of Search ..... 355/308, 309, 133; 152/154.2; 492/9-11; 271/278, 314, 8.1

[56] References Cited

U.S. PATENT DOCUMENTS

| | | | |
|---|---|---|---|
| Re. 30,518 | 2/1981 | French | 152/154.2 |
| 2,706,509 | 4/1955 | White | 152/154.2 |
| 3,578,055 | 5/1971 | French et al. | 152/330 |
| 3,808,658 | 5/1974 | Looney | 29/110 |
| 3,814,160 | 6/1974 | Creasey | 152/330 |
| 4,149,797 | 4/1979 | Imperial | 355/3 FU |
| 4,287,649 | 9/1981 | Kohler | 29/130 |
| 5,142,760 | 9/1992 | Bell | 29/130 |
| 5,342,037 | 8/1994 | Martin | 271/111 |

OTHER PUBLICATIONS

Statutory Invention Registration No. H1283 Inventor: Porto et al.-Published Feb. 1, 1994.

*Primary Examiner*—R. L. Moses

*Attorney, Agent, or Firm*—Denis A. Robitaille

[57] ABSTRACT

A roll member, typically for use in a sheet transport system, including a body portion that is susceptible to wear, wherein a visually distinguishable wear indicator is provided for indicating a predetermined amount of wear in the body of the roll member.

26 Claims, 4 Drawing Sheets

ROLL MEMBER WEAR INDICATOR

The present invention relates to a rotational member that is susceptible to wear and, more particularly, to a roll member for use in an electrostatographic machine, wherein the roll member includes means for providing an indication of deterioration or wear of the peripheral surface thereof.

There are numerous applications requiring that paper or some other article be moved along a path by a roll member mounted on a rotating shaft. In particular, printing machines and electrostatographic reproduction apparatus use idler rolls in conjunction with drive rolls to form a nip that conveys or transport copy sheets or other document media via frictional contact therewith. A typical paper transport comprises a solid cylindrical bar having feed rolls secured thereto. Friction rollers having high surface friction characteristics relative to the friction between sheets to be separated are also employed in envelope feeding devices. Some examples of prior art paper transport systems and roll members can be found in U.S. Pat. Nos. 3,808,658; 4,149,797; 4,287,649 and 5,142,760.

Heretofore, in applications where sheets are guided into a nip, hard surfaced rolls have tended to transmit, and sometimes magnify, sheet misalignment while conveying the sheets to another location. In addition, such hard surfaced roll members often do not provide sufficient friction to induce a constant velocity vector along the length of the sheet being transported. Accordingly, friction rollers having a relatively soft outer surface for providing high surface friction characteristics are generally employed. However, such high surface friction characteristics yield increased wear such that the paper drive roll decreases in diameter over its lifetime. Such a decrease in diameter results in variations in paper speed and skew, thereby causing shutdowns related to paper timing malfunctions. Accordingly, it is desirable to provide some easily identifiable indication for determining the amount of roll member wear.

The following disclosures may be relevant;

U.S. Pat. No. 3,578,055 Patentee: French et al. Issued: May 11,1971

U.S. Pat. No. 3,814,160 Patentee: Creasey Issued: Jun. 4, 1974

Statutory Invention Registration No. H1283 Inventor: Porto et al. Published: Feb. 1, 1994

The relevant portions of the foregoing disclosures may be briefly summarized as follows:

U.S. Pat. No. 3,578,055 discloses a pneumatic tire having a recess formed in the tread rubber thereof by cutting or molding a recess shoulder portion formed in the rubber bounding the recess, and a tread wear marker located in the recess having at least a part thereof located radially inwardly of the shoulder portion and secured in position thereby. The marker comprises, at least in part, material which may be distinguished either visually or audibly upon rotation of the tire on a hard surface for indicating a degree of tread wear which has occurred in the rubber adjacent the marker.

U.S. Pat. No. 3,814,160 discloses tires having a tread wear indicator wherein the tread has a surface portion of a first color and an interior subsurface tread wear indicator portion of a contrasting color. The tread has the same desirable wearing properties as carbon reinforced tire treads but at least one of the portions contains a reinforcing pigment.

Statutory Invention Registration H1283 discloses a tire for use on a land vehicle wheel, comprising a sidewall section and a tread section connected to the sidewall section which includes indicating means for indicating the state of tire tread wear. The indicating means described in the statutory invention registration includes a plurality of different plys connected together in layers with each layer covering essentially the entire surface area of the tread section, each having a tread pattern which extends over the entire surface area of the tread section with an innermost layer having a pattern shape which is different visually from the pattern shapes of all other plys. In addition, each ply further includes a color which is different from the color of all plys so that, as the tread section wears down during use of the tire, visually different plys will be exposed to indicate the state of the tread wear. The statutory invention registration discloses a tire having a double warning formed by different color and different tread patterns in the innermost layer thereof.

In accordance with one aspect of the present invention, there is provided a rotatable member including a body that is susceptible to wear having a thickness and peripheral surface extending between opposing end portions and means for providing a visual indication of wear in the body.

In another aspect of the present invention a drive transport system for transporting a substrate along a predetermined path is provided, comprising a rotatable shaft having a body that is susceptible to wear positioned axially thereon, the body having a peripheral surface and means for providing a visual indication of wear therein.

Pursuant to another aspect of the present invention, there is provided an electrostatographic printing machine including recording medium drive transport system for transporting a substrate along a predetermined path, comprising a rotatable shaft having a body that is susceptible to wear axially positioned thereon, the body having a thickness and a peripheral surface and means for providing a visual indication of wear therein.

Other features of the present invention will become apparent as the following description proceeds and upon reference to the drawings in which.

Figure 1:
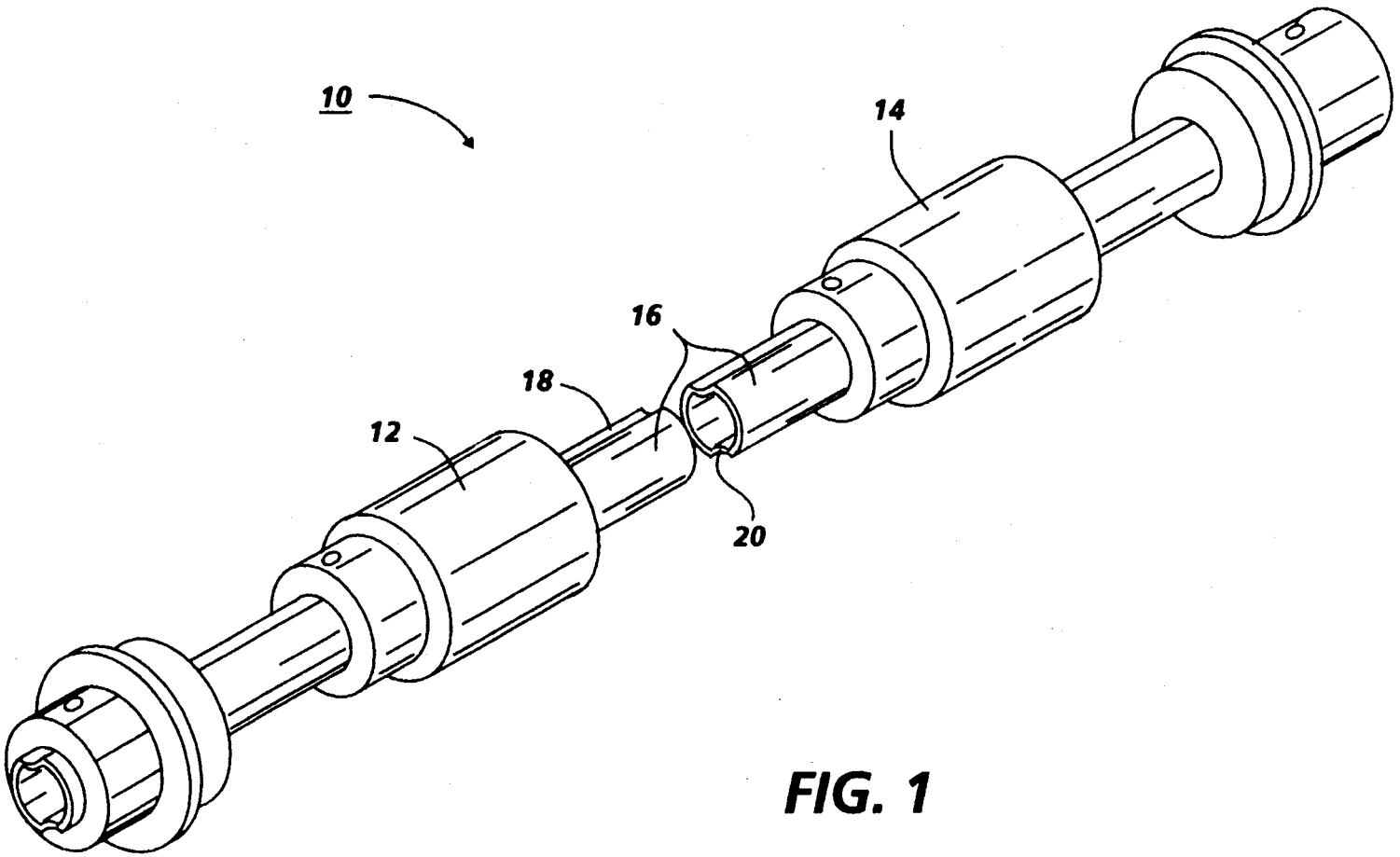
FIG. 1 is a perspective view showing one embodiment of a drive roll as may be utilized in a typical electrostatographic printing machine.

While the present invention will be described in connection with a preferred embodiment thereof, it will be understood that the detailed description thereof which follows is not intended to limit the invention to that embodiment. On the contrary, it is intended that the invention cover all alternatives, modifications, and equivalents as may be included within the spirit and scope of the appended claims. Other aspects and features of the present invention will become apparent as the description proceeds, wherein like reference numerals have been used throughout to designate identical elements.

Figure 7:
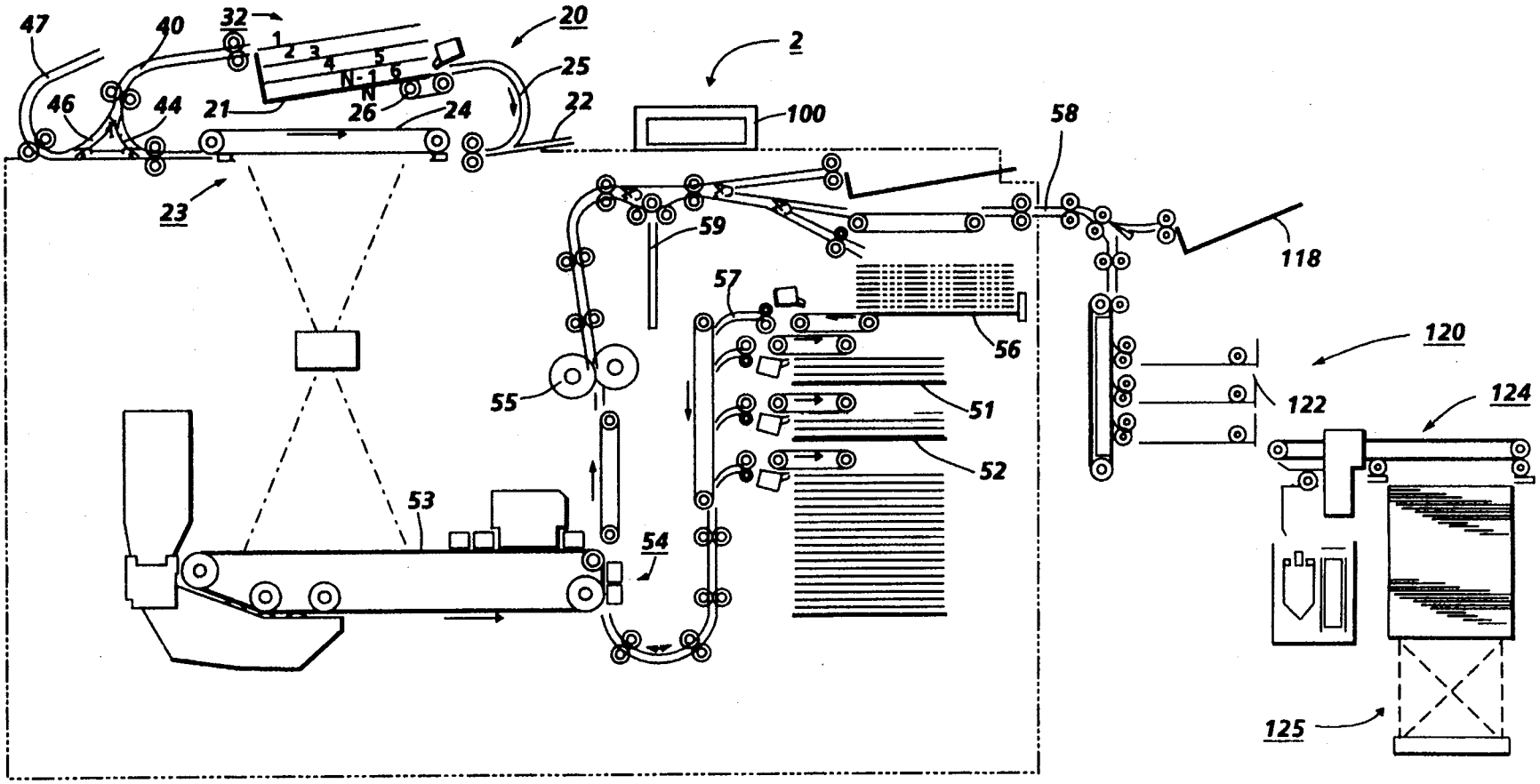
FIG. 7 is a schematic side view of an exemplary electrophotographic printing machine incorporating roll members having the features of the present invention therein.

Inasmuch as the art of electrostatographic printing machines is well known, the various processing stations employed in the reproduction machines of the present invention will initially be described briefly with reference to FIG. 7. It will become apparent from the following discussion that the roll member of the present invention is equally well suited for use in a wide variety of electrophotographic or other electronic printing systems as well as in any apparatus utilizing a roll member that is susceptible to wear.

Referring initially to FIG. 7, there is shown an illustrative electrostatographic printing machine in schematic form. The machine incorporates an exemplary recirculating document handler (RDH) 20 of a generally known type, which may be found, for example, in the well known Xerox Corporation model "1075" or "5090" duplicators. Such electrostatographic printing systems are illustrated and described in detail in various patents, including U.S. Pat. No. 4,961,092. The principal operation of the document handler will also be disclosed in various other xerographic or other printing machines.

A printing system of the type shown herein is preferably adapted to provide, in a known manner, duplex or simplex collated copy sets from either duplex or simplex original documents circulated by a document handler. As is conventionally practiced, the entire document handler unit 20 may be pivotally mounted to the copier 2 so as to be liftable up and away from a platen 23 by an operator for alternative manual document placement and copying. In this manner, the exemplary printing system 2 is designed to receive input documents either manually positioned on the platen glass 3 or automatically positioned through the document handler unit, also known as a recirculating document handler (RDH) 20.

The RDH 20 operates to automatically feed or transport individual registered and spaced document sheets onto and over the platen 23, which serves as the imaging station for the printing system 2. A platen transport system 24 is provided, which may be an incrementally servomotor driven non-slip or vacuum belt system controlled by the copier controller 100 in a manner taught by the relevant art to stop the document at a desired registration (copying) position. For clarity, the illustrated document and copy sheets are drawn here with exaggerated spacing between the sheets being stacked. In actual operation these stacked sheets would be directly superposed upon one another.

The RDH 20 has a conventional "racetrack" document loop path configuration, and preferably has generally known inverting and non-inverting return recirculation paths to the RDH loading and restacking tray 21. An exemplary set of duplex document sheets is shown stacked in this document tray 21. The RDH 20 is a conventional dual input document handler, having an alternative semiautomatic document handling (SADH) side loading slot 22. Documents may be fed to the same imaging station 23 and transported by the same platen transport belt 24 from either the SADH input 22 at one side of the RDH 20, or from the regular RDH input, namely the loading or stacking tray 21, on top of the RDH unit. As noted, the second document feeding input 22 is referred to herein as the SADH input 22, although it is not limited to semi-automatic or "stream feeding" document input feeding; that is, the SADH input 22 is also known to be usable for special "job interrupt" insert jobs.

Normal RDH document feeding input comes from the bottom of the stack in tray 21 through an arcuate, inverting RDH input path 25 to the upstream end of the platen transport 24. Input path 25 preferably includes a known "stack bottom" corrugated feeder-separator belt and air knife system 26, document position sensors (not shown), and a first set of turn baffles and feed rollers for naturally inverting an input document prior to copying. Document inverting or non-inverting by the RDH 20 is further described, for example, in the United States patents U.S. Pat. Nos. 4,794,429 or 4,731,637, as well as numerous other references. Briefly, after the documents are copied on the platen imaging station 23, or fed across the platen without copying, they may be ejected by the platen transport system 24 into downstream or off-platen rollers and fed past a gate or a series of gates and sensors. Depending on the position of these gates, the documents are either guided directly to a document output path and then to a catch tray, or, more commonly, the documents are instead deflected by a decision gate, past an additional sensor, and into an RDH return path 40, leading the documents back to tray 21 so that the document set can be continually recirculated. This RDH return path 40 includes reversible rollers to provide a choice of two different return paths to the RDH tray 21: a simplex return path 44 with one inversion; or a reversible duplex return path 46 without an inversion. For the duplex path 46, the reversible rollers are rotated in an opposite direction to reverse feed the previous trail edge of the sheet back into the duplex return path 46 from an inverter chute 47. This duplex return path 46 provides for the desired inversion of duplex documents in one circulation as they are returned to the tray 21 for copying opposite sides of these documents in a subsequent circulation or circulations. Typically, this RDH inverter and inversion path 46, 47 is used only for documents loaded through RDH input tray 21 loaded documents and only for duplex documents.

In normal operation, a duplex document has only one inversion per circulation (occurring in the RDH input path 24). By contrast, in the simplex circulation path there are two inversions per circulation, one in each of the paths 24 and 44. Two inversions per circulation equals no inversion. Thus, simplex documents are returned to tray 21 in their original (face up) orientation via the simplex path 44.The entire stack of originals in the RDH tray 21 can be plurally recirculated and copied to produce a plurality of collated copy sets or the document set or stack may be RDH recirculated any number of times to produce any desired number of collated duplex print sets, that is, collated sets of duplex copy sheets. Mode selection and operation of the RDH is made in accordance with various instruction sets known as print jobs which can be programmed into the controller 100.

Since the copy or print operation and apparatus of the present invention is well known and taught in the cited and other art, the system will not be described in detail herein. Briefly, blank or pre-printed copy sheets are conventionally fed from paper trays 51 or 52 (or the high capacity feeder tray shown thereunder) to receive a copier document image from photoreceptor 53 at transfer station 54. Such copy sheets are fused in a fuser 55, and output (if they are to be simplex copies), or, temporarily stacked in a duplex buffer tray 56 if they are to be duplexed, for subsequent return (inverted) via path 57 for receiving a second side image in the same manner as the first side. This duplex tray 56 has a finite predetermined sheet capacity, depending on the particular copier design. The completed duplex copy is preferably transported to an integral finishing and stacking module via output path 58. An optionally operated copy path sheet inverter 59 is also provided.

Output path 58 is directly connected in a conventional manner to a generally known bin sorter 120, as is generally disclosed in U.S. Pat. No. 3,467,371. Bin sorter 120 includes a vertical bin array 122 which is conventionally gated to deflect a selected sheet into a selected bin as the sheet is transported past the bin entrance. An optional gated overflow top stacking or purge tray may also be provided for each bin set. The vertical bin array 122 may also be bypassed by actuation of a gate therein to direct sheets serially onward. The resulting sets of prints are then discharged to finisher 124 which may include a stitcher for stapling print sets together and/or a thermal binder for adhesively binding the print sets into books. A stacker 125 is also provided for receiving and delivering final print sets to an operator or to an external third party device.

All copier and document handler and sorter operations are preferably controlled by a generally conventional programmable controller 100. The controller 100 is additionally programmed with certain novel functions and graphic user interface features described herein for the operation of the electrostatographic printing system 2. The controller 100 preferably comprises a known programmable microprocessor system, as exemplified by extensive prior art, e.g., U.S. Pat. No. 4,475,156, and its references, for controlling the operation of all of the machine steps and processes described herein. This includes the actuation of the document and copy sheet feeders and inverters, gates, etc. As further taught in the prior art, the controller 100 also conventionally provides for storage and comparison of the counts of the copy and document sheets, the number of documents fed and recirculated in a document set, the desired number of copy sets, and other functions which may be input into the machine by the operator through a connecting panel of numerical and other control or through a variety of customized graphic user interface screens. Controller information and sheet path sensors are utilized to control and keep track of the positions of the respective document and copy sheets making up a print set and the operative components of the apparatus by their connection to the controller. The controller 100 may be conventionally connected to receive and act upon jam, timing, positional and other control signals from various sheet sensors in the document recirculation paths and the copy sheet paths. The controller 100 automatically actuates and regulates the positions of sheet path selection gates depending upon which mode of operation is selected and the status of copying in that mode.

Referring now to FIG. 1, there is shown a transport assembly 10 having a pair of rollers 12 and 14 axially mounted along the length of a shaft 16. It will be understood that shaft 16 may be a hollow, thin wall tube having a pair of grooves 18 formed along its length, as shown, or the shaft may be a solid rod-type member. Rollers 12, 14 can serve, for example, as feed rollers in a xerographic copier, as previously described, for feeding paper sheets from a stack to an image transfer zone. In a typical configuration for facilitating this operation, a pair of transport assemblies 10 are positioned parallel to one another such that the rollers mounted on each shaft are juxtaposed in abutting relationship with one another, forming a nip therebetween.

In the type of typical configuration described above, the transport assembly is formed from a drive roller, which is coupled to some drive means, and an idler roller which is merely rotatably mounted in such a manner as to form a nip with the drive shaft for generating a frictional force on a sheet substrate passing therebetween. The drive roller has a high friction surface which contacts the bottom side or non-image side of the sheet substrate or recording medium and provides the transporting force therefor. Typically, the idler rollers are free to move downwardly under gravity to place a normal force on the drive rollers, so that when a recording medium is moved between the nip formed by the drive roller and the idler rollers, the frictional surface of the drive roller will transport it until the trailing edge of the recording medium is moved from the nip. Optionally, a biasing force is applied to the idler rollers to place a positive normal force on the recording medium, thus eliminating the possibility of a stall condition when the friction forces between the recording medium and the drive roller surface are low.

Figure 6:
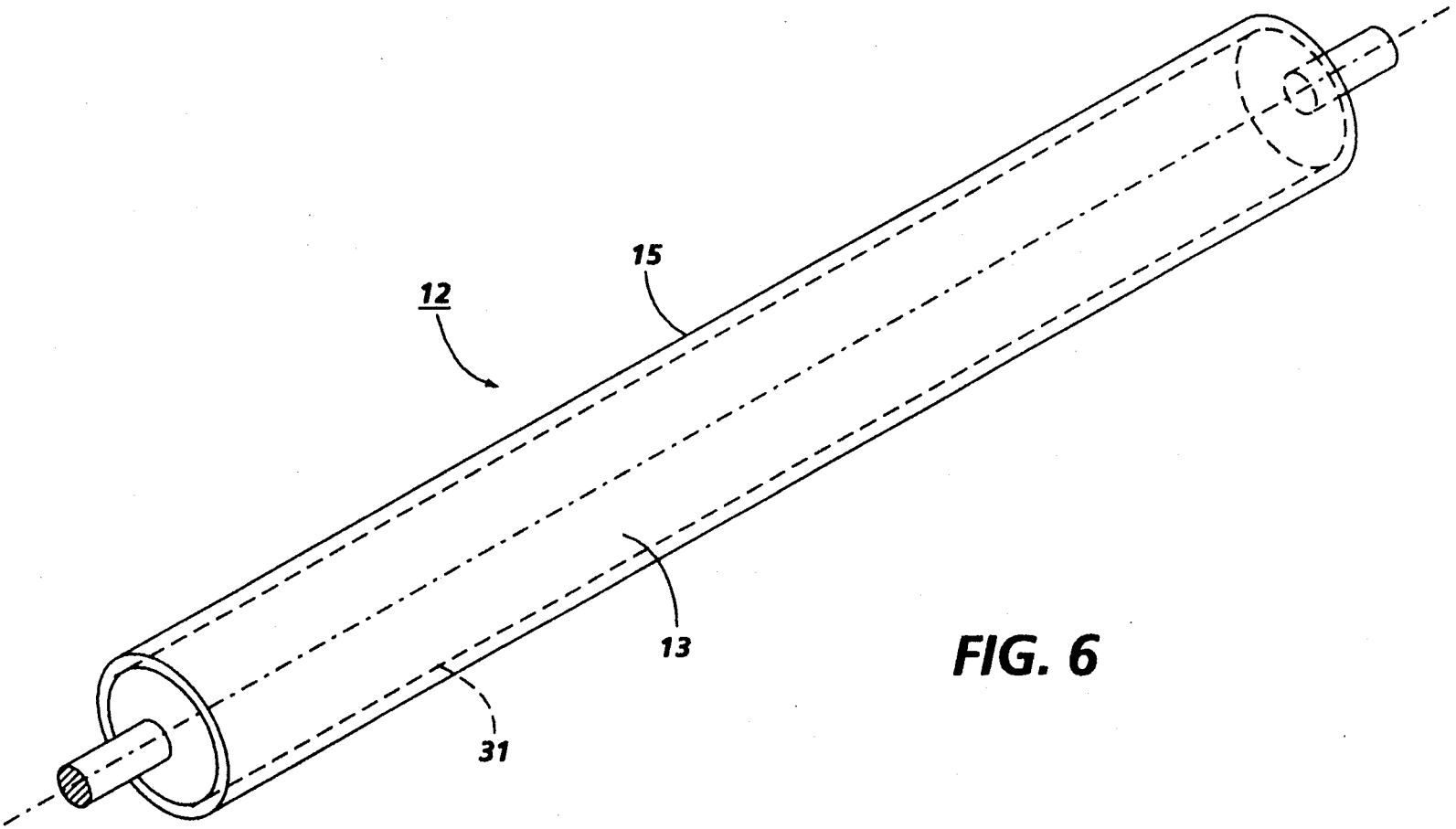
FIG. 6 is a perspective view of yet another alternative embodiment of the roll member of the present invention.

Alternative configurations are also contemplated by the present invention. For example, the roll improvement disclosed herein may be incorporated into a conveyor transport mechanism wherein a conveyor belt is entrained about the circumference of a group of rollers for transporting the conveyor belt along a predetermined path of travel. In this configuration, the drive roller would likely be embodied in a singular elongated roll member, as shown in FIG. 6, as opposed to a pair of smaller roll members positioned on a shaft, as shown in FIG. 1.

Moving now to the specific features of the present invention, it will be recognized by one of skill in the art that a drive roller as described hereinabove and, in particular, used in a configuration as described wherein friction contact is generated to provide transport, is susceptible to wear which results in deterioration and erosion of the peripheral surface of the roller. While wear occurs in normal use, the problem of wear can be exacerbated by extremely high volumes of paper runs as is found in state of the art high volume copying machines, as well as by particularly abrasive recording materials or the like. Wear in the amount of as little as one millimeter or less can cause timing problems in delivering or transporting recording mediums from station to station as the diameter of the roll member is directly proportional to the velocity at which the recording medium will be transported. Additional failures caused of roll member wear may manifest themselves through insufficient contact pressure between the idler and drive rolls or interference from other apparatus and devices caused by insufficient roll diameter. Recognizing the problems associated with roll wear, the present invention is directed toward the facilitation of identifying such wear prior to roll failure so as to prevent paper misfeeds and corresponding down time in the machine.

It is therefore desirable to have some means for warning a user or a maintenance representative when a roll member is worn to an extent that it has exhausted its useful life or is deteriorating to that end.

Figure 2:
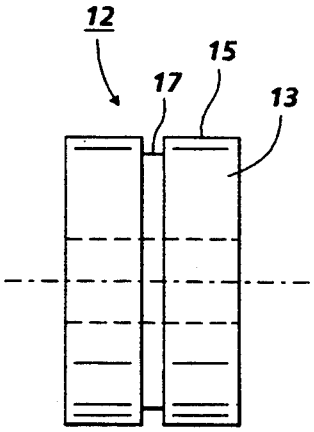
FIG. 2 is an elevational view of a roll member having a wear indicator in accordance with the present invention.
Figure 3:
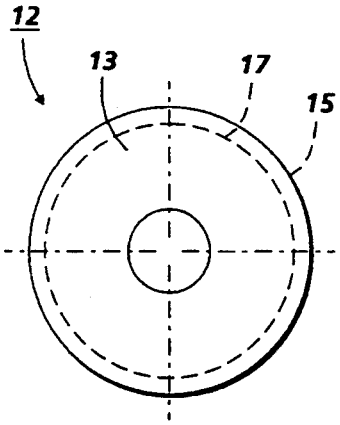
FIG. 3 is a side view of the roll member shown in FIG. 2.

A first embodiment of the present invention is shown in FIG. 2, wherein the invention comprises a roll member 12 including a body 13 having a peripheral surface 15. The roll member 12 has a recess 17 formed in the body 13 thereof extending radially inward from the peripheral surface 15 to a predetermined depth corresponding to the failure diameter of the roll member 12. As the surface 15 of the roll 12 erodes due to wear, the depth of the recess will gradually decrease and will eventually disappear. In the practice of the present invention, the recess 17 provides an indicia of wear in the roll member 12 such that the disappearance of the recess provides a visual indication that the roll member is worn beyond its useful life. While the recess of the present embodiment is shown as a groove extending around the circumference of the roll member, it will be understood that the recess can take many shapes, including, for example, a small circular or elliptical pocket shaped into the surface 15 of the roll member 12.

Figure 4:
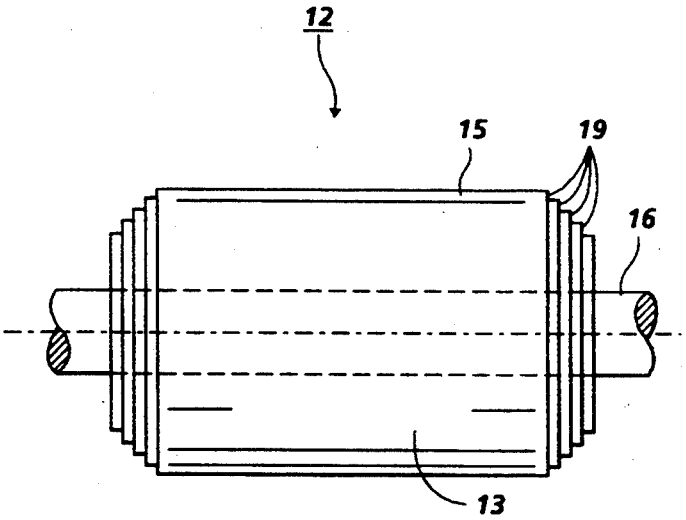
FIG. 4 is an elevational view of an alternative embodiment of the drive roll of the present invention.
Figure 5:
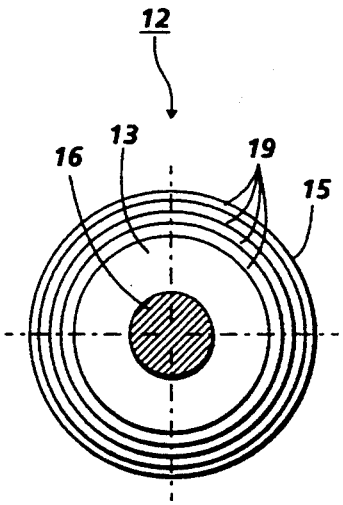
FIG. 5 is a side view of the roll member shown in FIG. 4.

An alternative embodiment of the present invention is shown in FIGS. 4 and 5. This exemplary alternative embodiment comprises a roll member 12 having a body 13 and a plurality of concentric rings 19 formed along opposite end portions of the roll member. Each concentric ring 19 has a predetermined diameter or thickness, forming a series of ridges or shoulder segments along the end portion of the roller member. This embodiment provides a graduated indication of depth of wear such that gradual wear of the roll member eliminates a given ring to provide not only an indication of wear beyond a failure point but also an indication of the amount of wear existing in a given roll member. This embodiment provides the added benefit of indicating a given amount of wear through quick visual inspection of the roll member so that a user or a technical representative might be alerted that the roll member, while not at its failure mode, is approaching the failure mode such that an educated prediction of the failure event can be approximated. Furthermore, this multi-layer embodiment allows for flexibility in designing one roll member that may be used in various machines. That is, while the same roll may be used in various machines or at various locations within a machine, failure may occur with various degrees of wear. This embodiment allows for use of the same roll in various environments while providing an indication of wear that is useful. The embodiment described hereinabove also provides the ability to observe an "out-of-round" condition in the roll member body, which may be beneficial in determining causes of failure.

Yet another alternative embodiment of the present invention is illustrated in FIG. 6. In this embodiment, a roll member 12 is provided with a sub-layer 31 of visually distinguishable material, located at a predetermined depth below the peripheral surface 15. This sub-layer 31 may be of a different color than the material making up the body 13 or may have an embedded pattern which provides an indicia of wear in a manner such that gradual deterioration of the peripheral surface 15 of the roll member 12 eventually leads to the exposure of the sub-layer. Clearly, by providing this sub-layer 31 in a color which is substantially different than the material making up the roll member, the sub-layer 31 provides an easily identifiable indicia of wear for the roll member. This embodiment provides advantageous benefits in that the indicia of wear may be exposed at any given point along the length of the roll member 12 such that uneven wear of a roll member will be identified.

It is, therefore, evident that there has been provided, in accordance with the present invention, a roller member having an indicia of wear. While the roller member of the present invention has been described in conjunction with various embodiments thereof, it is evident that many alternatives, modifications and variations will be apparent to those skilled in the art. Accordingly, this invention is intended to embrace all such alternatives, modifications and variations as may fall within the spirit and broad scope of the appended claims.

We claim:

1. A rotatable member, comprising:

a body including a cylindrical roll that is susceptible to wear, said body having a thickness and a peripheral surface extending between opposing end portions; and means for providing a visual indication of wear in said body.

2. The roll member of claim 1, wherein said means for providing a visual indication of wear includes a recess formed in said peripheral surface and extending inwardly therefrom into said body to a predetermined depth such that elimination of said recess indicates a predetermined amount of wear in said body.

3. The rotatable member of claim 1, wherein said means for providing a visual indication of wear includes a shoulder segment having a predetermined thickness less than the thickness of said body such that elimination of said shoulder segment indicates a predetermined amount of wear in said body.

4. The rotatable member of claim 3, wherein said shoulder segment is located adjacent to at least one of said opposing end portions of said body.

5. The rotatable member of claim 3, wherein said shoulder segment includes a plurality of concentric portions each having a predetermined thickness less than the thickness of said body such that elimination of any given one of said plurality of concentric portions indicates a predetermined amount of wear in said body.

6. The rotatable member of claim 1, wherein said means for providing a visual indication of wear includes a sub-layer located within said body at a predetermined depth below said peripheral surface such that exposure of said sub-layer indicates a predetermined amount of wear in said body.

7. The rotatable member of claim 6, wherein said sub-layer is visually distinguishable from said body.

8. The rotatable member of claim 7, wherein said body includes a first color associated therewith and said sub-layer includes a second color associated therewith.

9. A drive transport system for transporting a substrate along a predetermined path, comprising:

a rotatable shaft having a body that is susceptible to wear axially positioned thereon, said body having a thickness and a peripheral surface extending between opposing end portions; and means for providing a visual indication of wear in said body.

10. The drive transport system of claim 9, wherein said body includes a cylindrical roll.

11. The drive transport system of claim 9, wherein said means for providing a visual indication of wear includes a recess formed in said peripheral surface and extending inwardly therefrom into said body to a predetermined depth such that elimination of said recess indicates a predetermined amount of wear in said body.

12. The drive transport system of claim 9, wherein said means for providing a visual indication of wear includes a shoulder segment having a predetermined thickness less than the thickness of said body such that elimination of said shoulder segment indicates a predetermined amount of wear in said body.

13. The drive transport system of claim 12, wherein said shoulder segment is located adjacent to at least one of said opposing end portions of said body.

14. The drive transport system of claim 12, wherein said shoulder segment includes a plurality of concentric portions each having a predetermined thickness less than the thickness of said body such that elimination of any given one of said plurality of concentric portions indicates a predetermined amount of wear in said body.

15. The drive transport system of claim 9, wherein said means for providing a visual indication of wear includes a sub-layer located within said body at a predetermined depth below said peripheral surface such that exposure of said sub-layer indicates a predetermined amount of wear in said body.

16. The drive transport system of claim 15, wherein said sub-layer is visually distinguishable from said body.

17. The drive transport system of claim 16, wherein said body includes a first color associated therewith and said sub-layer includes a second color associated therewith.

18. An electrostatographic printing machine including a recording medium drive transport system for transporting a substrate along a predetermined path, comprising:

a rotatable shaft having a body that is susceptible to wear axially positioned thereon, said body having a thickness and a peripheral surface extending between opposing end portions; and means for providing a visual indication of wear in said body.

19. The electrostatographic printing machine of claim 18, wherein said body includes a cylindrical roll.

20. The electrostatographic printing machine of claim 18, wherein said means for providing a visual indication of wear includes a recess formed in said peripheral surface and extending inwardly therefrom into said body to a predetermined depth such that elimination of said recess indicates a predetermined amount of wear in said body.

21. The electrostatographic printing machine of claim 18, wherein said means for providing a visual indication of wear includes a shoulder segment having a predetermined thickness less than the thickness of said body such that elimination of said shoulder segment indicates a predetermined amount of wear in said body.

22. The electrostatographic printing machine of claim 20, wherein said shoulder segment is located adjacent to at least one of said opposing end portions of said body.

23. The electrostatographic printing machine of claim 22, wherein said shoulder segment includes a plurality of concentric portions each having a predetermined thickness less than the thickness of said body such that elimination of any given one of said plurality of concentric portions indicates a predetermined amount of wear in said body.

24. The electrostatographic printing machine of claim 18, wherein said means for providing a visual indication of wear includes a sub-layer located within said body at a predetermined depth below said peripheral surface such that exposure of said sub-layer indicates a predetermined amount of wear in said body.

25. The electrostatographic printing machine of claim 24, wherein said sub-layer is visually distinguishable from said body.

26. The electrostatographic printing machine of claim 25, wherein said body includes a first color associated therewith and said sub-layer includes a second color associated therewith.

* * * * *